United States Patent [19]

Snider et al.

[11] 4,146,256

[45] Mar. 27, 1979

[54] CLOSURE LATCH ASSEMBLY

[75] Inventors: Peter M. Snider, Dallas, Tex.; Paul C. Gebhard, Little Falls, N.J.

[73] Assignee: Ellcon-National, Inc., Totowa, N.J.

[21] Appl. No.: 867,577

[22] Filed: Jan. 6, 1978

[51] Int. Cl.[2] ..... E05B 63/04; E05B 63/08

[52] U.S. Cl. ..... 292/173; 292/223; 292/DIG. 47; 70/208

[58] Field of Search ..... 292/191, 161, 223, 173, 292/DIG. 31, DIG. 70, DIG. 35, DIG. 47, DIG. 46; 70/150, 153, 208

[56] References Cited

U.S. PATENT DOCUMENTS

| | | | |
|---|---|---|---|
| 1,069,753 | 8/1913 | Appleby | 292/173 |
| 1,508,540 | 9/1924 | Cantrell | 292/173 |
| 1,629,494 | 5/1927 | Forsyth | 292/173 |
| 2,191,931 | 5/1937 | Collins | 292/173 |
| 2,672,745 | 3/1954 | Marchetti | 70/101 |
| 3,300,238 | 1/1967 | Fleskes | 292/173 |
| 3,707,862 | 1/1973 | Pastva | 292/173 X |
| 3,807,203 | 4/1974 | Larsen | 70/150 X |

*Primary Examiner*—J. Franklin Foss

*Attorney, Agent, or Firm*—Brooks, Haidt, Haffner & Delahunty

[57] ABSTRACT

A latch assembly for use on a closure, e.g. a sash, the assembly comprising a housing from which a slidable, spring-biased latch bolt extends, an actuating handle pivotally mounted at one end in the housing for pivotal movement in a plane parallel to the plane of movement of the bolt and having an opposite end portion extending from a portion of the housing spaced from the portion of the housing from which the bolt extends and a pair of bolt-lifting levers pivotally mounted intermediate their ends within the housing, one end of each lever being engagable with the bolt and the opposite end of each lever being engagable by a projection on the handle intermediate its ends for withdrawing the bolt. When the handle is pivoted in one direction, one lever is engaged and lifts the bolt whereas when the handle is oppositely pivoted, the other lever is engaged and lifts the bolt. The levers are free to pivot when the bolt is pushed inwardly from externally of the housing.

8 Claims, 7 Drawing Figures

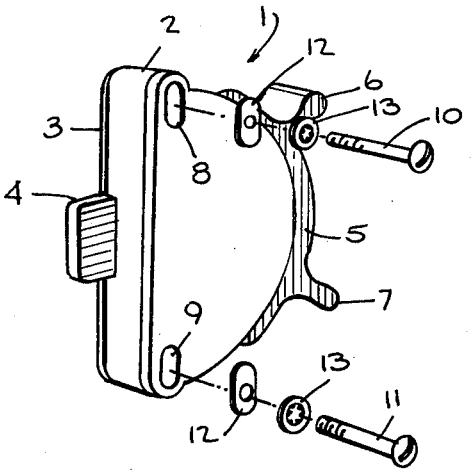
Fig. 1.
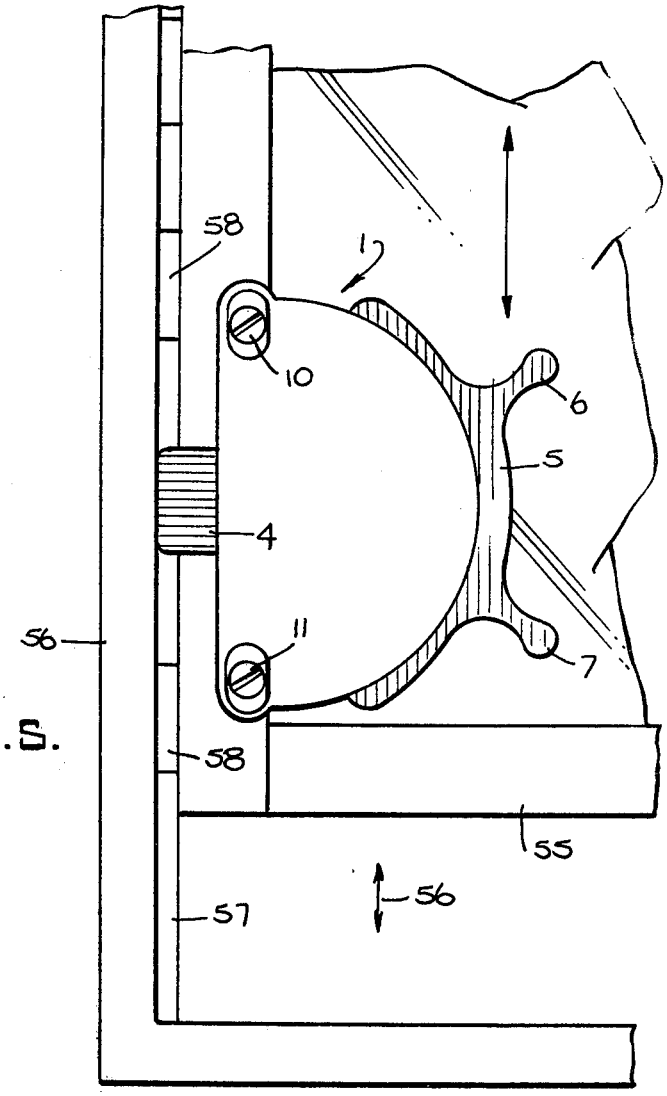
Fig. 5.
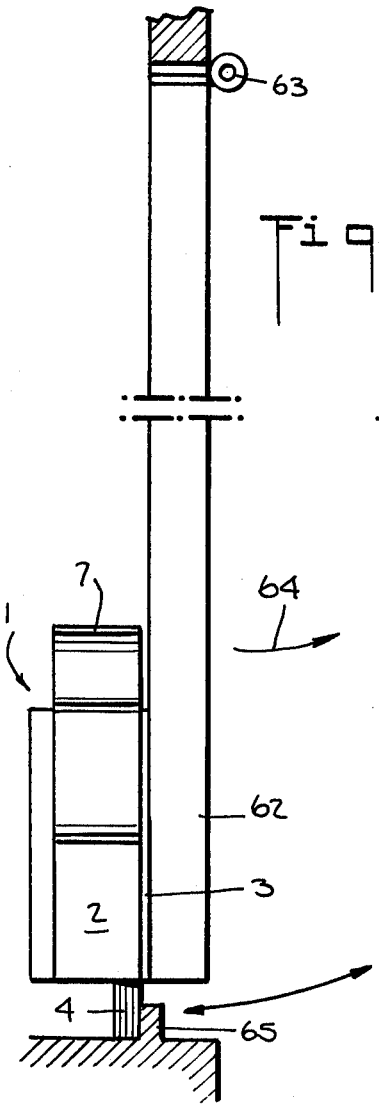
Fig. 7.
Fig. 6.
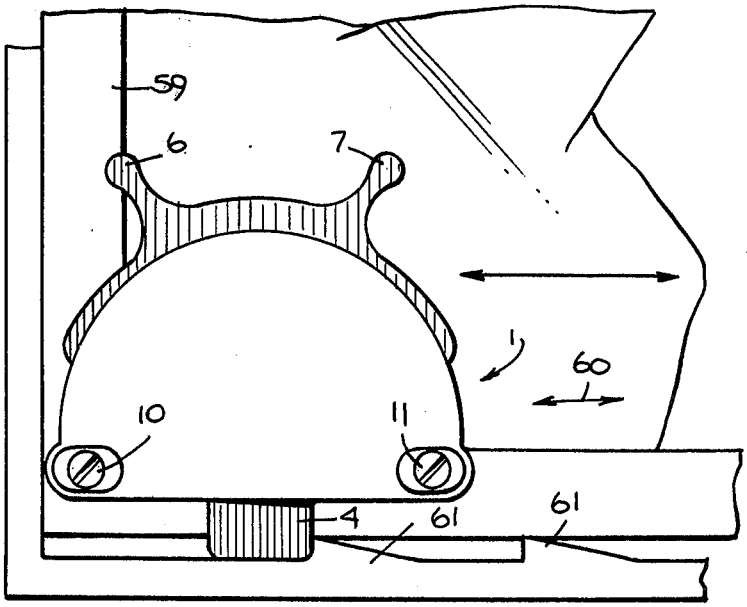

CLOSURE LATCH ASSEMBLY

This invention relates to latches for closures, such as sash, doors, etc., for openings in buildings, vehicles, appliances, etc. and particularly to a latch for sash employed in vehicles such as buses.

Latches for the purposes for which the latch of the invention is intended are well known in the art. However, some of such latches are not sufficiently sturdy for use in public vehicles, require substantial manual forces to operate and/or are relatively complicated in structure. Furthermore, not all such latches can be operated by moving the operating handle in either of two directions.

One object of the invention is to provide a sturdy latch which can be operated with the application of relatively small forces to the operating handle.

Another object of the invention is to provide a latch operating structure which can be readily used either for latches having a handle which will withdraw the latch bolt only when moved in one direction or for latches having a handle which will withdraw the latch bolt when it is moved in either of two directions.

In accordance with the preferred embodiment of the invention, the latch comprises a housing from which a spring biased latch bolt extends. An end portion of an actuating handle also extends from a portion of the housing different from the portion thereof from which the latch bolt extends and the opposite end of the handle is pivotally mounted within the housing. The handle can be pivoted in either of two directions, and when it is pivoted in one direction, a projection thereon, internally of the housing, engages an end of a lever pivotally mounted intermediate its ends, the other end of the lever engaging and withdrawing the latch bolt. Similarly, when the lever is pivoted in the other direction, a projection on the handle engages another similar lever which engages and withdraws the same latch bolt. The projections engage only one side of the lever ends and the lever ends are free to move away from the projections when the latch bolt is moved inward by the application of forces thereto externally of the housing, such as by moving the closure to which the latch is secured and causing the bolt to ride over latching teeth, thereby avoiding damage to the latch mechanism and eliminating movement of the latch handle during such movement of the closure.

Other objects and advantages of the present invention will be apparent to those skilled in the art from the following description of presently preferred embodiments thereof, which description should be considered in conjunction with the accompanying drawings in which:

FIG. 1 is an exploded view of the latch assembly of the invention and its mounting screws and washers;

Figure 2:
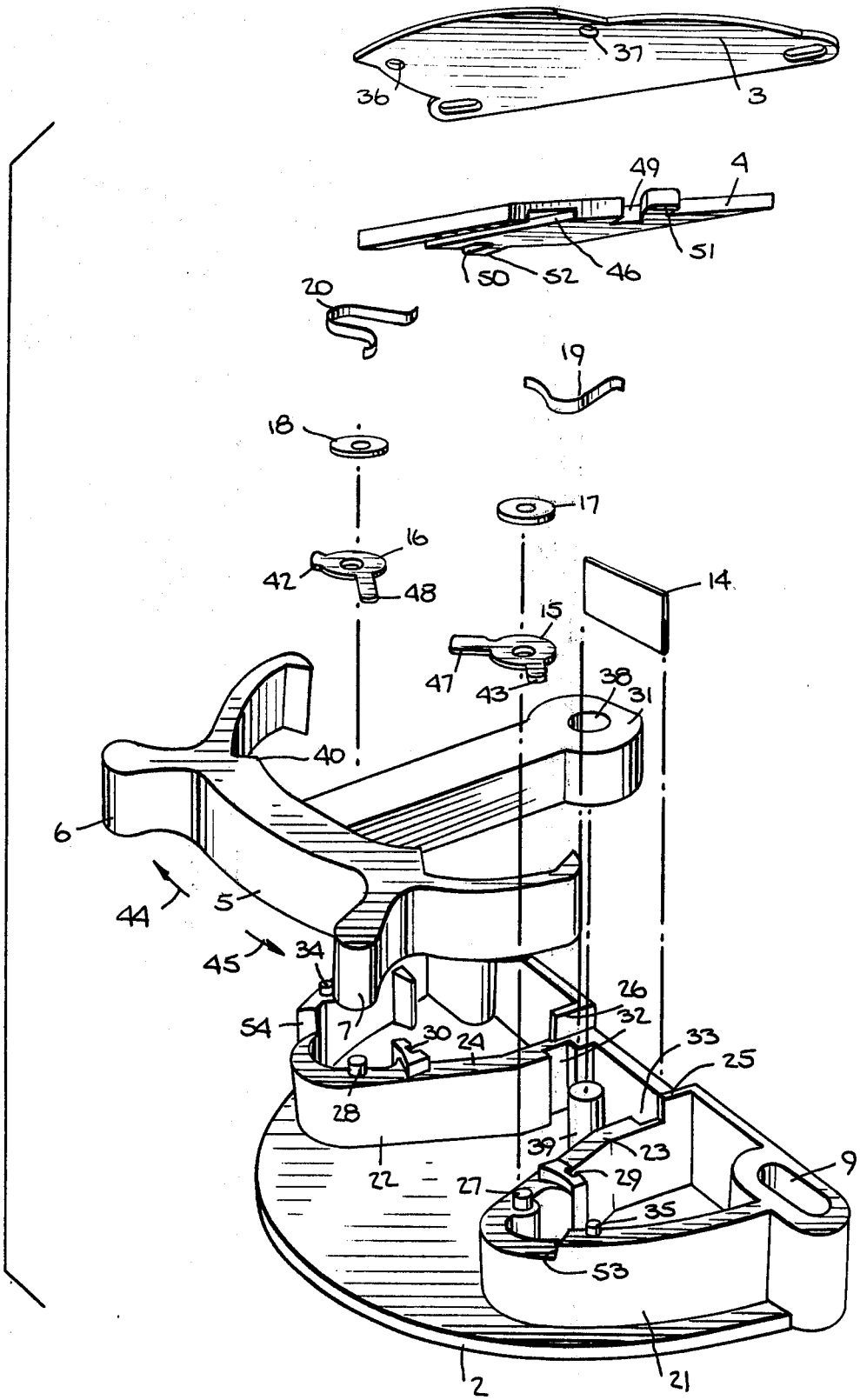
FIG. 2 is an exploded view of the preferred latch assembly of the invention.
Figure 3:
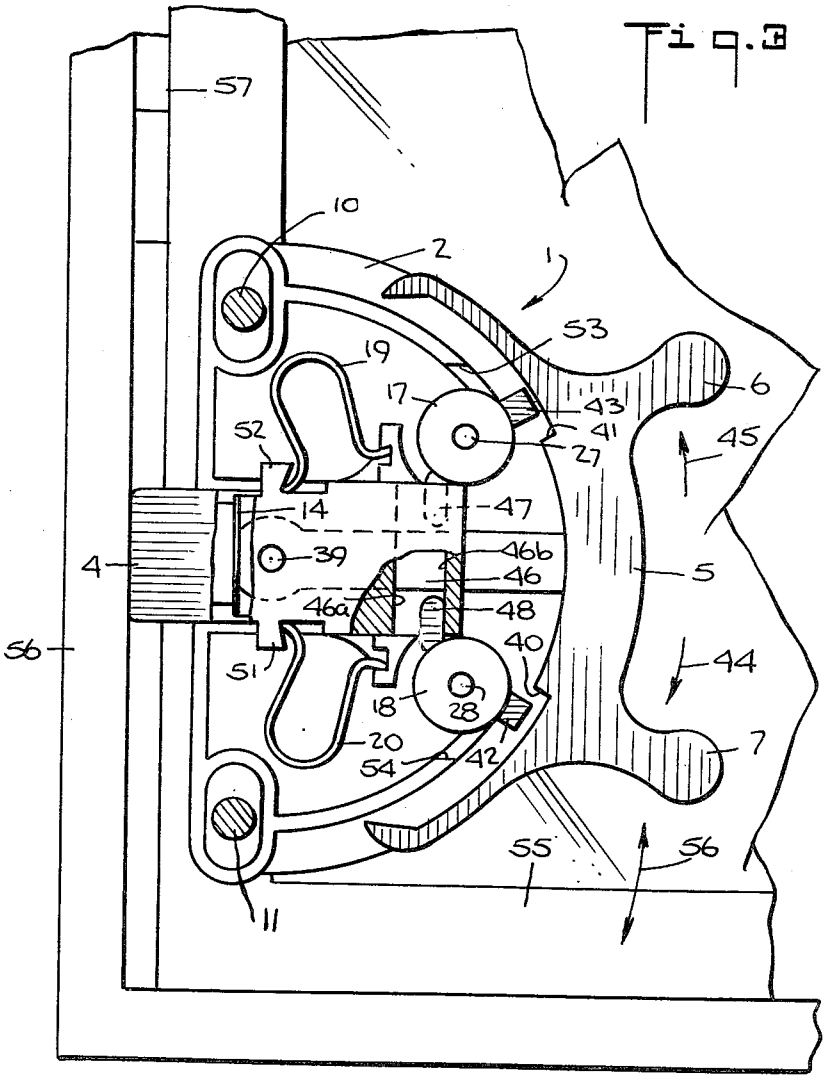
FIG. 3 is an enlarged, side elevation view corresponding to FIG. 2 but with the latch housing cover removed and a portion of the latch bolt broken away.
Figure 4:
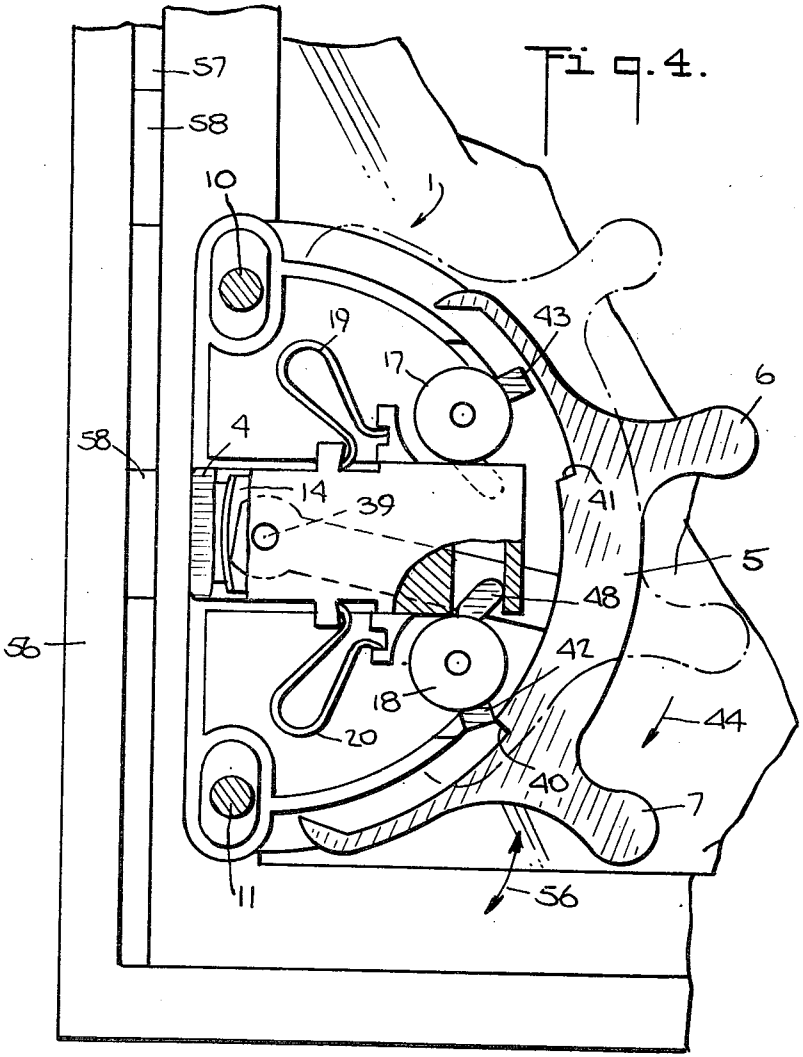

FIG. 4 corresponds to FIG. 3 but shows the actuating handle pivoted in a first direction;

FIG. 5 is a fragmentary, side elevation view of the latch assembly shown in FIG. 1 mounted on a vertically slidable sash;

FIG. 6 is similar to FIG. 2 but shows the latch assembly of the invention mounted on a horizontally slidable sash; and FIG. 7 is an end elevation view illustrating the use of the latch assembly of the invention on a hinged sash.

The invention will be described in connection with its use as a latch for sliding or hinged sash, but it will be understood by those skilled in the art that the latch of the invention has other uses.

The latch assembly 1 shown in FIG. 1 comprises a housing 2 having a cover 3. A portion of a retractable latch bolt 4 extends from one portion of the housing 2 and an actuating handle 5 having two ears 6 and 7 extends from the opposite portion of the housing 2. The housing 2 has a pair of through-holes 8 and 9 through which mounting screws 10 and 11 may extend, suitable washers 12 and 13 normally being used beneath the heads of the screws 10 and 11. The holes 8 and 9 preferably are elliptical to permit adjustment of the position of the assembly 1.

The preferred embodiment of the latch assembly 1 of the invention is illustrated in an exploded view in FIG. 2. In addition to the parts described in connection with FIG. 1, the assembly comprises a leaf spring 14, a pair of bolt lifting levers 15 and 16, a pair of spacing washers 17 and 18, and a pair of U-shaped springs 19 and 20. Preferably, all the parts are made of metal, and the housing 2, the handle 5 and the bolt 4 may, for example, be aluminum castings.

The housing 2 has a pair of internal walls 21 and 22 which support and guide the bolt 4, receive one end of each of the springs 19 and 20 and support the levers 15 and 16 and the washers 17 and 18. Thus, the bolt 4 is supported by the portions 23 and 24 of the walls 21 and 22 and is guided and limited in its outward movement by the portions 25 and 26. A pair of pins 27 and 28 pivotally mount the levers 15 and 16 intermediate their ends. One end of each of the springs 19 and 20 is received, respectively, in the slots 29 and 30, and the opposite ends of the leaf spring 14, which acts with the flattened portion of the end 31 of the handle 5 to return the handle 5 to its central or de-activated position shown in FIG. 1, are received in slots 32 and 33. It will be observed that once the arcuate portions of the end 31 engage the spring 14, the force of the spring 14 does not oppose the manual force applied to the handle 5. Pins or projections 34 and 35 on the walls 21 and 22 are received in holes 36 and 37 in the cover 3 and may be expanded at their ends after insertion in the holes 36 and 37 to retain the cover 3 on the housing 2.

The end 31 of the handle 5 has an opening 38 adjacent for receiving a pin 39 on the housing 2 for pivotally mounting the handle 5 on the housing 2. The opposite end portion of the handle 5, including the ears 6 and 7, extends outwardly of the housing and has a pair of projecting portions 40 and 41, inwardly of the housing 2, which engage the ends 42 and 43 of the levers 16 and 15 when the handle 5 is pivoted. Thus, when the handle 5 is pivoted in the direction of the arrow 44, the end 42 is engaged (see FIG. 4) and when the handle 5 is pivoted in the direction of the arrow 45, the end 43 is engaged.

The bolt 4 has a slot 46 for receiving the ends 47 and 48 of the levers 15 and 16 and has a pair of cavities 49 and 50 for receiving an end of each of the springs 19 and 20 which urge the bolt 4 outwardly of the housing 2. Projections 51 and 52 on the bolt 4 engage the wall portions 25 and 26 and limit the movement of the bolt 4 outwardly of the housing 2. Alternatively, the projections 25 and 26 could be omitted and replaced by projections on the walls 21 and 22 which limit, respectively clockwise and counterclockwise movement of the levers 15 and 16 and thereby limit outward movement of the bolt 4.

FIG. 3 shows the handle 5 in its normal, de-activated position to which it is returned by the leaf spring 14 acting on the flattened portion of the end 31. When the handle 5 is moved in the direction of the arrow 44 the projection 40 engages the end 42 of the lever 16 (FIG. 4) causing the opposite end 48 of the lever 16 to lift, or withdraw, the bolt 4 and causing compression of the springs 19 and 20. When the handle 5 is released, it is returned to the position shown in FIG. 3 by the leaf spring 14 assisted by the springs 19 and 20 which cause the bolt 4 to move outwardly of the housing 2. Of course, if the springs 19 and 20 have sufficient strength and the ends 42 and 43 are in contact with the projections 40 and 41 when the handle 5 is in the position shown in FIG. 3, the leaf spring 14 may be omitted. Pivoting of the handle 5 is limited by the projecting portions 53 and 54 on the walls 21 and 22, the lever ends 43 and 44 being engagable, respectively, with the projections 53 and 54.

Similarly, when the handle is pivoted in the direction of the arrow 45, the projection 41 engages the end 43 of the lever 15 and causes withdrawal of the bolt 4.

Accordingly, in the preferred embodiment of the invention, the handle 5 is pivotable in a plane parallel to the plane of movement of the bolt 4 and has a pivot axis intersecting the center line of the bolt 4. The handle 5 can be pivoted either in a first direction or a second direction to cause the bolt 4 to move in a direction inwardly of the housing 2. However, if desired and if a less versatile latch is acceptable one-half of the handle 5 external to the housing 2 and one of the levers, 15 or 16, may be omitted, and the bolt 4 may be withdrawn by pivoting of the handle 5 in only one direction.

The springs 19 and 20 may apply relatively light forces to the bolt 4 because it is necessary that they apply only the forces required to move the bolt 4 to its extended position. Furthermore, the springs 19 and 20 apply substantially equal forces on opposite sides of the bolt 4, thereby reducing binding friction between the bolt 4 and the housing 2. In this way, the manual forces required to pivot the handle 5 for withdrawal of the bolt 4 are kept to a minimum.

Generally speaking, the maximum manual force required to withdraw the bolt 4 will be required during initial movement of the handle 5. It will be observed from FIG. 3 that when the ends 47 and 48 first engage the bolt 4, the levers 15 and 16 provide the highest lever ratio, e.g. maximum lever advantage, and thereby keep the manual force required on the handle 5 relatively low. At the time the projections 40 and 41 respectively engage the ends 42 and 43, or shortly thereafter, the leaf spring 14 no longer applies a restoring force to the handle, again reducing the manual force required.

FIGS. 3, 4 and 5 show the latch assembly 1 of the invention mounted on a vertically slidable sash 55, the sash 55 being slidable in the directions indicated by the double-ended arrow 56. A frame 56 adjacent the sash 55 has a slotted strip 57, with a plurality of slots 58 into which the bolt 4 fits. Thus, when the bolt 4 is in a slot 58, the sash 55 is held in a fixed position, and when the bolt 4 is withdrawn by actuation of the handle 5, the sash 55 may be raised or lowered.

FIG. 6 illustrates the use of the latch assembly 1 mounted on a sash 59 which is horizontally slidable in the directions indicated by the double-ended arrow 60. The bolt 4 is engagable with ratchet teeth 61 fixed in position with respect to the sash 59. When the bolt 4 engages a tooth 61, the sash 59 cannot be moved to the right as viewed in FIG. 6. However, if the bolt 4 engages a tooth 61 other than the leftmost tooth 61, as viewed in FIG. 6, the sash 59 may be slid to the left without actuating the handle 5 because the ends 42 and 43 of the levers 15 and 16 are free to move in a direction which permits the bolt 4 to ride over the teeth 61. It will be noted that the projections 41 and 42 engage only one side of the ends 42 and 43, the handle 5 being recessed sufficiently to permit free clockwise and counterclockwise rotation, respectively, of the levers 16 and 15.

FIG. 7 illustrates the use of the latch assembly 1 mounted on a hinged sash 62, the sash 62 being secured at its upper edge to a hinge 63 and being pivotable in the direction indicated by the arrow 64. The bolt 4 is engagable with a lip or strike 65 mounted on, or part of, the frame 66 for the sash 62. When the bolt 4 is withdrawn by actuation of the handle 5, the sash may be pivoted in the direction of the arrow 64. If desired, the bolt 4 may be bevelled at its lower edge to permit the bolt 4 to ride over the lip 65 when the sash 62 is moved into its closed position, shown in FIG. 7, without actuation of the handle 5.

As mentioned hereinbefore, the handle 5 is recessed and the projections 40 and 41 engage, respectively, the ends 42 and 43 at only one side to permit the L-shaped levers 15 and 16 to pivot freely when the bolt 4 is pushed inwardly from externally of the housing 2. It will be observed that the distance between the walls 46*a* and 46*b* of the slot 46 (see FIG. 3) is greater than the width of the ends 47 and 48 of the levers 15 and 16, and therefore, the bolt 4 is permitted to move inwardly, when pushed inwardly from externally of the housing 2, by at least a significant amount before the ends 47 and 48 are engaged by the wall 46*a*. If it is desired that projections on the handle 5 engage both sides of the ends 42 and 43 and to permit free movement of the bolt 4 to its fully withdrawn position, the projections 40 and 41 could be shaped, e.g. U-shaped, so as to engage both sides of the ends 42 and 43 if the lower wall 46*a* is spaced far enough from the upper wall 46*b* of the slot 46 to enable the bolt 4 to be withdrawn without engagement of the lower wall 46*a* with the ends 47 and 48 of the levers 15 and 16. In this way, the bolt 4 may be moved inwardly without pivoting of the levers 15 and 16.

Although preferred embodiments of the present invention have been described the illustrated, it will be understood by those skilled in the art that various modifications may be made without departing from the principles of the invention.

THE EMBODIMENTS OF THE INVENTION IN WHICH AN EXCLUSIVE PROPERTY OR PRIVILEGE IS CLAIMED ARE DEFINED AS FOLLOWS:

1. A latch assembly for closures, said assembly comprising a housing, a latch bolt slidably mounted in said housing for rectilinear, sliding movement in a plane and in directions inwardly and outwardly of said housing, spring means acting between said housing and said bolt and urging said bolt outwardly of said housing at a first portion of the latter, a bolt actuating handle pivotally mounted at one end within said housing for pivotal movement around a first axis in a plane parallel to said plane of movement of said bolt, said handle having an end portion spaced from said end thereof which extends outwardly of a second portion of said housing spaced from said first portion thereof, a bolt lifting lever pivotally mounted intermediate its ends in said housing for pivotal movement around a second axis intermediate said first axis and said end portion of said handle, said lever having one of its ends engagable with said bolt, said lever, when pivoted in a first direction, moving said bolt in the direction inwardly of said housing against the force of said spring means, and when pivoted in a second direction, permitting a portion of said bolt to extend from said housing, lever engaging means on said handle intermediate said end thereof and said end portion thereof and engagable with the opposite end of said lever for pivoting said lever in said first direction when said handle is pivoted, said lever engaging means being disposed on the side of said second axis which is opposite from the side thereof at which said first axis is disposed, whereby said lever engaging means moves in an arcuate path centered on said first axis and which intersects said opposite end of said lever, and stop means on said housing limiting the outward movement of said bolt whereby only said portion of said bolt extends outwardly from said first portion of said housing under the urging of said spring means.

2. A latch assembly as set forth in claim 1 wherein said bolt slides along a rectilinear path and said handle has is said first pivot axis intersecting said path, and wherein said bolt has a slot extending from one side to the other thereof for receiving said one end of said lever.

3. A latch assembly as set forth in claim 2 wherein said spring means comprises a U-shaped spring, said bolt having an aperture for receiving one end of said spring and said housing having a slot for receiving the other end of said spring.

4. A latch assembly as set forth in claim 2 wherein said end of said handle has a flattened portion joining an arcuate portion, and further comprising leaf spring means mounted on said housing and engaging said flattened portion for urging said handle into a position in which said lever engaging means permits said lever to permit said portion of said bolt to extend from said housing.

5. A latch assembly as set forth in claim 1 wherein said lever engaging means engages one side of said opposite end of said lever and said opposite end of said lever is unobstructed by said handle at the opposite side of said opposite end of said lever, whereby said lever is free to pivot in said first direction when forces are applied externally of said housing to said portion of said bolt to move said bolt inwardly of said housing.

6. A latch assembly as set forth in claim 1 wherein said bolt is free to move inwardly against the force of said spring means without engaging said one end of said lever.

7. A latch assembly as set forth in claim 6 wherein said bolt has a slot therein for receiving said one end of said lever and wherein said slot is wider than said end of said lever whereby said end of said lever is engagable with one wall of said slot and the other end of said lever is out of engagement with the other wall of said slot.

8. A latch assembly as set forth in claim 1 wherein said bolt lifting lever is at one side of said bolt and said lever engaging means on said handle engages said lever when said handle is pivoted in a first direction and further comprising a further, similar, bolt lifting lever similarly pivotally mounted intermediate its ends in said housing at the opposite side of said bolt and with one of its ends engageable with said bolt, said further lever, when pivoted in a first direction, moving said bolt in the direction inwardly of said housing against the force of said spring means and when pivoted in a second direction, permitting said portion of said bolt to extend from said housing; said handle having further lever engaging means similar to said first-mentioned lever engaging means and similarly disposed intermediate said end thereof and said end portion thereof and engagable with the opposite end of said further lever when said handle is pivoted in a second direction opposite to said first direction in which it is pivotable.

* * * * *